United States Patent [19]

Brown et al.

[11] Patent Number: 4,708,048

[45] Date of Patent: Nov. 24, 1987

[54] MUNITIONS ASSEMBLY SYSTEM

[75] Inventors: Wallace L. Brown, Guntersville, Ala.; O. Mark Madamba, Fort Walton Beach, Fla.

[73] Assignee: Ver-Val Enterprises, Inc., Fort Walton Beach, Fla.

[21] Appl. No.: 862,995

[22] Filed: May 14, 1986

[51] Int. Cl.[4] ..... F41F 3/04

[52] U.S. Cl. ..... 89/1.805; 89/46; 212/218

[58] Field of Search ..... 89/1.805, 46; 212/218

[56] References Cited

U.S. PATENT DOCUMENTS

| | | | |
|---|---|---|---|
| 879,387 | 2/1902 | Ihlder . | |
| 1,051,056 | 1/1913 | Bachelet | 214/56 |
| 2,499,271 | 2/1950 | Harvey et al. | 89/46 X |
| 2,835,395 | 5/1958 | Curtenius | 214/130 |
| 2,864,516 | 12/1958 | Rogers . | |
| 3,024,925 | 3/1962 | Werner et al. | 214/75 |
| 3,520,514 | 7/1970 | Evans | 212/13 |
| 3,872,988 | 3/1975 | Day | 89/1.805 |

*Primary Examiner*—Peter A. Nelson

*Attorney, Agent, or Firm*—Robbins & Laramie

[57] ABSTRACT

A system for the rapid assembly of munitions comprising a roller conveyor extending from beneath an on-load gantry, a hoist attached to the on-load gantry, a rail conveyor extending from the on-load gantry to an off-load gantry, a hoist attached to the off-load gantry and dollies which travel between the gantries on the rail conveyor. A munition body is delivered to the on-load gantry by the roller conveyor. The munition body is hoisted onto a dolly and assembly and arming tasks are performed as the munition-laden dolly travels on the rail conveyor. The assembled and armed munition is then removed from the dolly by a hoist on the off-load gantry.

18 Claims, 11 Drawing Figures

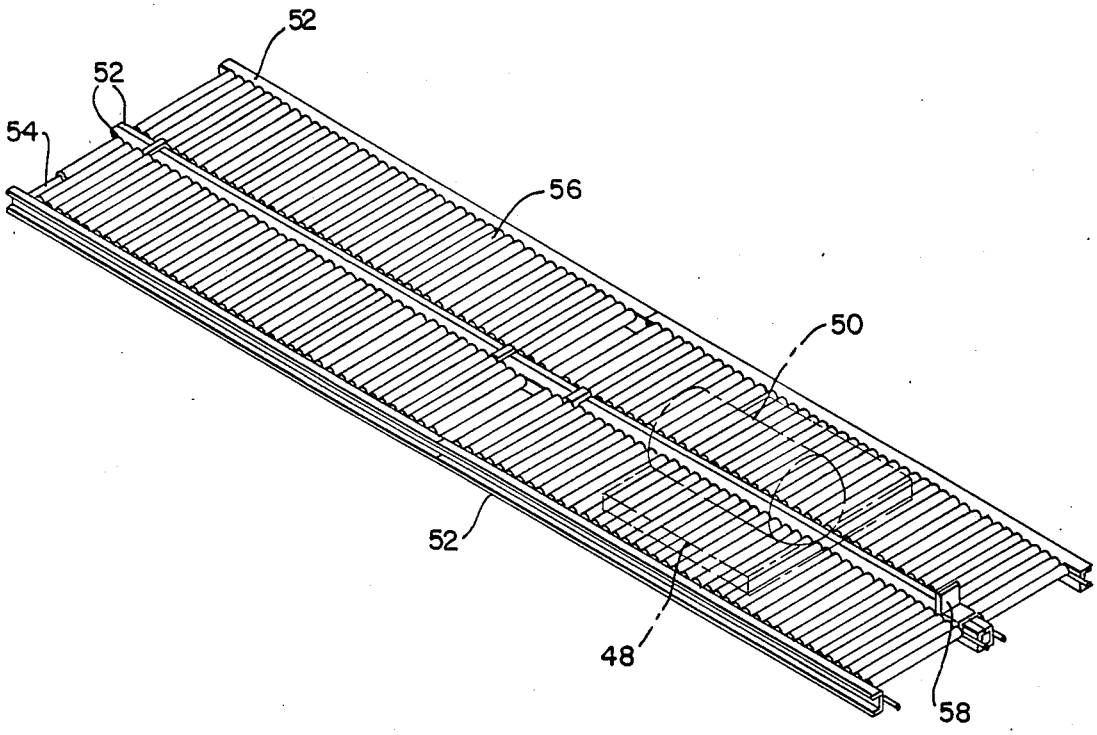
FIG 2
FIG 9
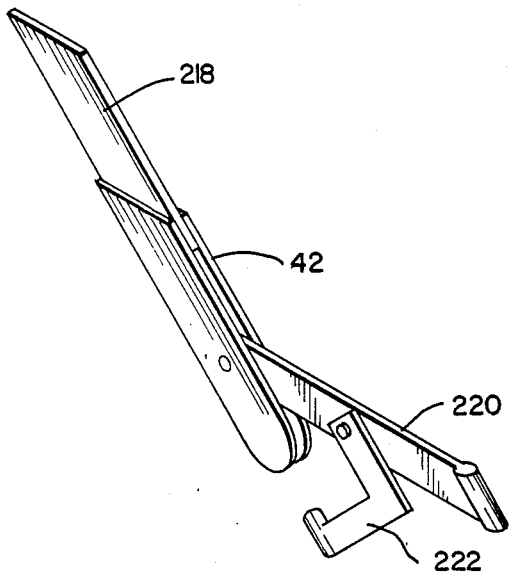

FIG 4
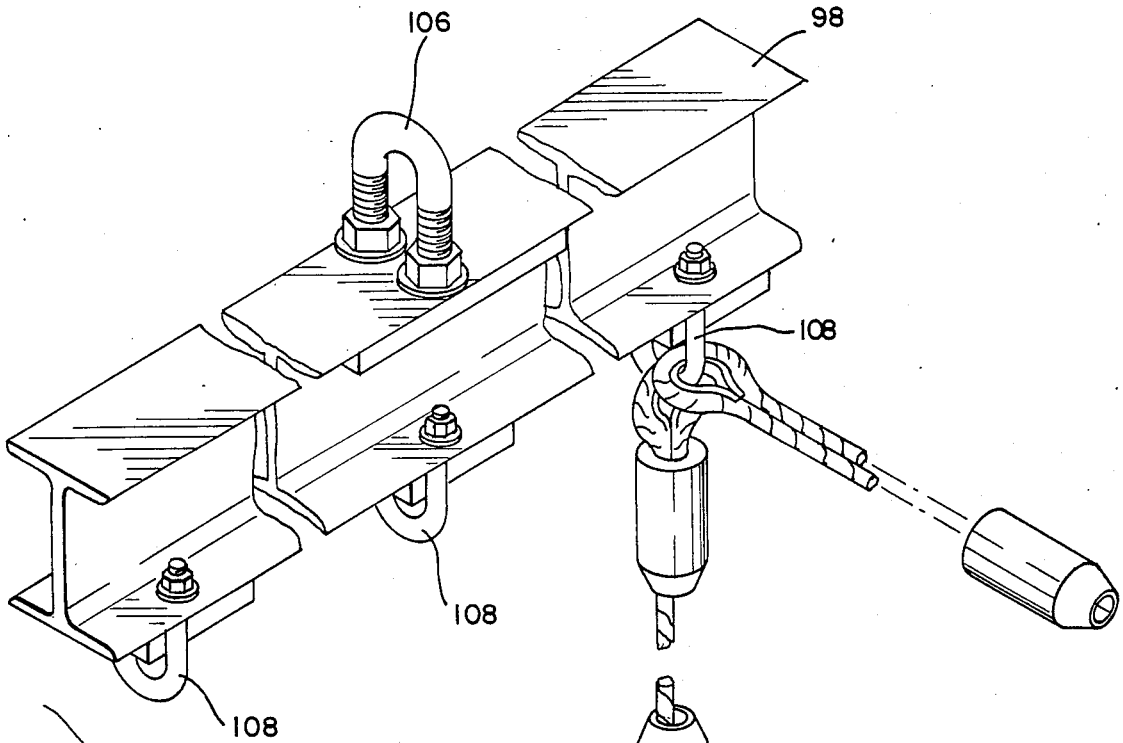
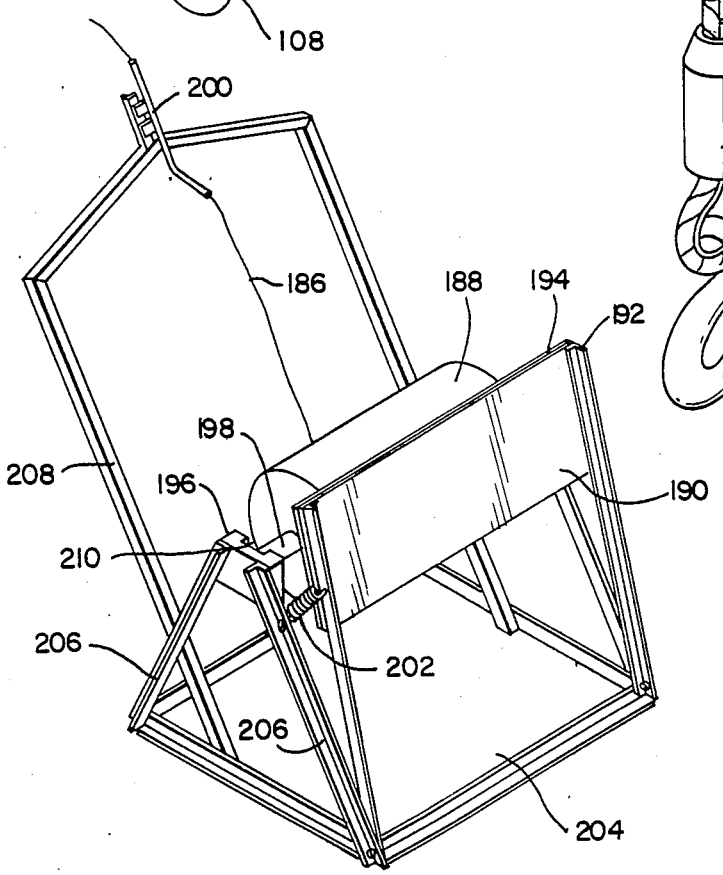
FIG 8

MUNITIONS ASSEMBLY SYSTEM

BACKGROUND OF THE INVENTION

Prior art systems for assembling munitions are crude and labor intensive. The prior art procedure consists of placing 4×4 boards on level ground or a level surface in such an arrangement that a warhead will be supported by the boards in a stationary position, elevated above the level surface. The warhead is the largest part of a munition, and contains the explosive charge.

Once the warhead has been positioned in the 4×4 framework, technicians work around the warhead performing the tasks necessary for the arming of the munition. These tasks include: (1) removing closure plugs in the nose and tail of the warhead, the closure plugs being left in place until their removal in order to prevent corrosion of the warhead; (2) attaching a fin assembly to the warhead; (3) installing boosters into areas previously sealed by the closure plugs; (4) installing fuses into the boosters which have been secured in place; and (5) applying arming wire to engage the fuses. Due to the location of the warhead and the above-described tasks to be performed, the technicians spend a great amount of time bending over the warhead. This is a very uncomfortable position in which to work, and the location and non-mobility of the warhead make some of the tasks awkward and difficult to perform.

SUMMARY OF THE INVENTION

The present invention relates to an assembly system that allows the rapid build-up of conventional munitions. The munitions armed and assembled by this munitions assembly system include, but are not limited to, general purpose bombs, guided bombs, leaflet bombs and incendiary clusters.

The invention comprises a number of components. Among the components is an on-load gantry and one or more off-load gantries, all of which have hoisting means attached thereto. A first conveyor means extends from an unloading site to a location beneath the on-load gantry, and second conveyor means extend between the on-load gantry and the off-load gantries. A bomb bar is attachable to each of the hoisting means and a plurality of transport means travel between the on-load gantry and off-load gantries on the second conveyor means.

In a preferred embodiment of the invention, roller conveyors transport a munition to be built up from its unloading site to an on-load gantry. The on-load gantry supports a pneumatic hoist with a bomb bar attached thereto. The hoist and bomb bar are utilized to raise the munition from the roller conveyor onto a munitions dolly. The munitions dolly travels on a rail conveyor and is stopped intermittently for different tasks in the munition build-up to be performed. One such task may be the application of arming wire from an arming wire dispenser. When the munitions dolly arrives at an off-load gantry, at the opposite end of the rail conveyor, another pneumatic hoist and bomb bar coact to lower the munition into a munitions trailer for transport to a holding area or loading area. The entire system is illuminated by lighting systems mounted on both the on-load and off-load gantries.

Advantages of the present invention include the alleviation of the need for technicians to spend time in an uncomfortable bent over position while performing munition arming and assembling tasks, improved access to areas of the warhead at which arming and assembling tasks are performed, and an increase in the number of munitions that can be armed and assembled in a given time period.

BRIEF DESCRIPTION OF THE DRAWINGS

FIG. 2 is a perspective view of the second conveyor means of the munitions assembly system, said second conveyor means comprising a roller conveyor in the illustrated embodiment;

FIG. 4 is a perspective view of a bomb bar;

FIG. 8 is a perspective view of the arming wire dispenser;

FIG. 9 is a perspective view of an adjustment bar;

DETAILED DESCRIPTION OF THE PREFERRED EMBODIMENTS

The present munitions assembly system is utilized in the rapid build-up of many conventional munitions, including but not limited to, general purpose bombs, guided bombs, leaflet bombs and incendiary clusters.

Figure 1:
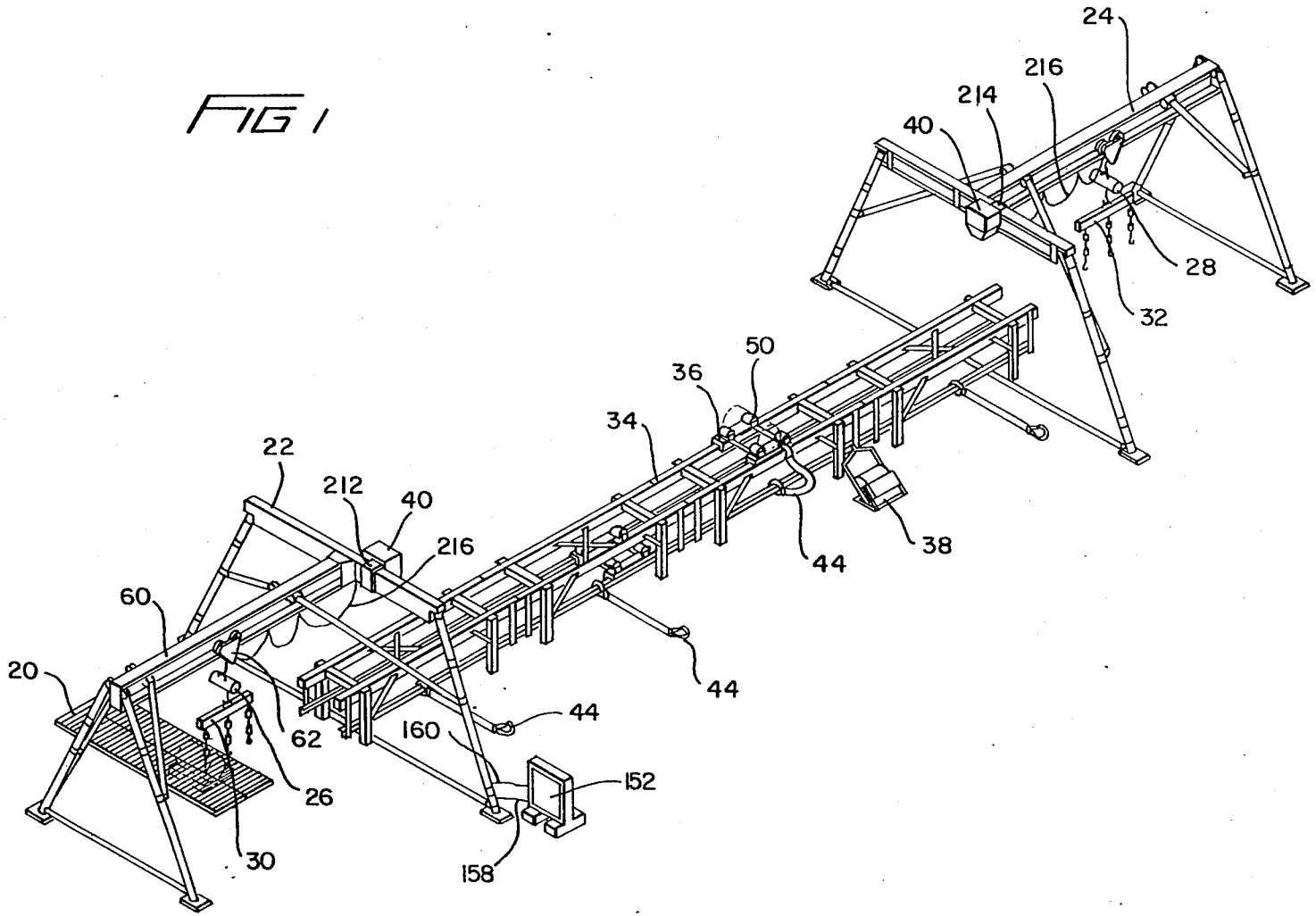
FIG. 1 is a perspective view of one embodiment of the munitions assembly system.

The munitions assembly system of FIG. 1 comprises a number of components. The components of the system include: a roller conveyor 20; an on-load gantry 22; an off-load gantry 24; a pneumatic hoist 26, attached to the on-load gantry; a pneumatic hoist 28, attached to the off-load gantry; a bomb bar 30 at the on-load gantry; a bomb bar 32 at the off-load gantry; rail conveyors 34; munition dollies 36; arming wire dispensers 38; lighting systems 40; and restraint straps 44.

FIG. 2 illustrates the roller conveyor 20 which is used to transport munitions pallets or munition containers to the on-load gantry 22 for breakout. Breakout is the process of opening the containers and preparing the munition body 50 for assembling and arming. The roller conveyor 20 must be aligned correctly in relation to the on-load gantry 22 so that the munition bodies 50 will be transported to a point directly below the pneumatic hoist 26 which is attached to the on-load gantry 22.

The roller conveyor 20 comprises parallel metal strips 52 connected by axles 54 onto which are mounted heavy-duty rollers 56. The roller conveyor 20 is assembled so to afford a double roller conveyor assembly about twenty feet in length. The double roller conveyor assembly is placed so as to have a slight slope downward from the point at which the munition pallets or containers are first placed on the roller conveyor 20 to the point beneath the pneumatic hoist 26. A pallet stop 58 is attached to the double roller conveyor assembly at the lowest point thereof. The pallet stop 58 acts to stop the munitions pallets or containers directly beneath the pneumatic hoist 26 after their decline down the roller conveyor 20. The slope of the inclined roller conveyor 20 must be carefully monitored, as too steep a slope may cause the pallets or containers to overrun the pallet stop 58 thereby causing injury and/or equipment damage, while not enough slope will require more time and energy to be expanded to get the pallets or containers to the breakout area.

When the pallets or containers arrive at the breakout area and are halted by the pallet stop 58, said pallets or containers 48 are located beneath the pneumatic hoist 26 that is attached to an I-beam 60 of the on-load gantry 22 by means of a hoist trolley 62. The pneumatic hoist 26 and hoist trolley 62 are best illustrated in FIG. 3.

Figure 3:
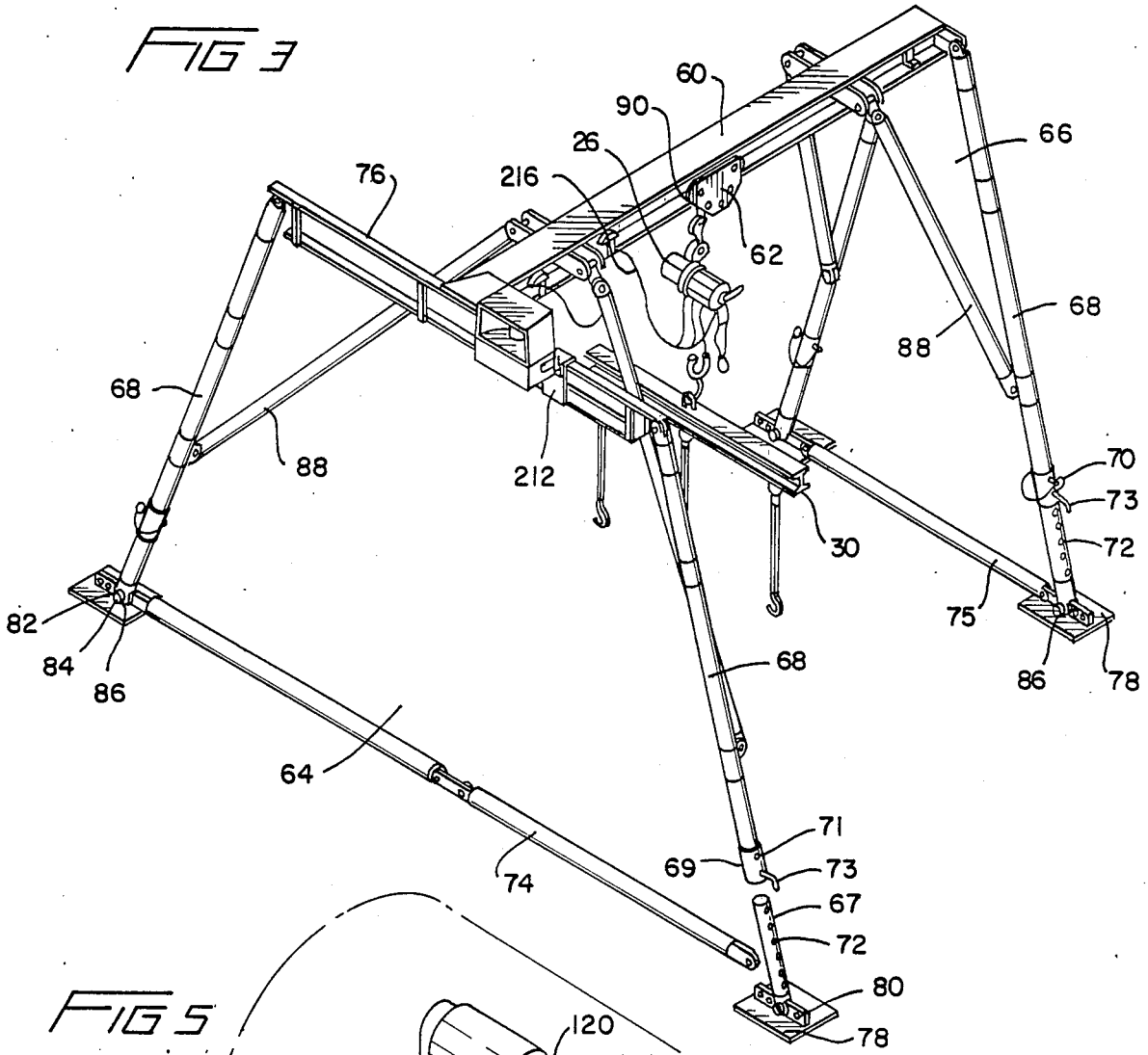
FIG. 3 is a perspective view of a gantry including an adjustment bar and lighting system.

As shown in FIG. 3, the on-load gantry 22, is of an A-frame style. The on-load gantry is assembled so as to allow the unloaded munition body 50, previously transported in its pallet or container by the roller conveyor 20, to be positioned directly beneath the pneumatic hoist 26 which is connected with the I-beam 60 of said on-load gantry 22.

The on-load gantry 22 is composed of the A-frame structures connected at their apexes by the previously identified I-beam 60. One A-frame structure may be wider than the other. The wider A-frame 64 is the one closer to the rail conveyor 34, while the narrower A-frame 66 is further from the rail conveyor 34. The legs 68 of the A-frame structures are adjustable in length, preferably by means of hitch pins 70 that extend through adjusting holes 72, located on an inner leg section 67, and adjusting holes 71, located on an outer leg section 69. The outer leg section 69 is slidably fitted over the inner leg section 67. When an adjusting hole 72 of the inner leg section 67 is aligned with an adjusting hole 71 of the outer leg section 69, the hitch pin 70 is inserted through the two holes. The adjustable legs 68 allow the A-frame structures to be sturdy even if assembled on an uneven surface. Each outer leg section 69 also has a lift tab 73 which is mated with an arm 220 of the adjustment bar 42 when the adjustment bar is used to adjust the legs of the gantry if it is assembled on a non-level surface. The wider A-frame 64 has a longer tie rod 74 than the tie rod 75 of the narrow A-frame 66. The wide A-frame 64 also makes use of a spreader beam 76 at the apex of the A-frame, which also contributes to its greater width.

The legs 68 of the A-frame structures have foot pads 78 on their lower ends. The foot pads 78 may be bolted or pinned to various surfaces to provide stability to the structure. The foot pads 78 are rectangular in shape and are adjustable in position at the lower ends of the legs 68 by means of a series of holes 80, any one of which may be aligned with a hole 82 in the leg terminus to permit a screw 84 to be placed through the aligned holes and a nut 86 threaded on the screw's end to keep the foot pad 78 in the selected position.

The tie rods 74 extend between the foot pads 78 of each respective A-frame structure to also aid in stabilizing the gantry. Leg braces 88 extending from the I-beam 60 to the legs 68 of each A-frame structure further add to the stability of the structure.

The off-load gantries 24 are of similar construction as shown in FIG. 1.

A pneumatic hoist 26 interacts with the I-beam 60 of the on-load gantry 22 by means of a hoist trolley 62. The hoist trolley 62 allows movement of the pneumatic hoist 26 along the length of the I-beam 60. A manual hoist may be utilized if the pneumatic hoist 26 malfunctions or breaks down, but the pneumatic hoist is the preferred hoisting means. The hoist trolley 62 interacts with the I-beam 60 by means of track wheels 90 that allow the trolley 62 to roll along the edge of the I-beam 60.

In a similar manner, a pneumatic hoist 28 interacts with an I-beam 61 of the off-load gantry 24 as shown in FIG. 1.

Interacting with pneumatic hoist 26 is a bomb bar 30. The bomb bar is best illustrated in FIG. 4. A bomb bar 30 is a light-weight lift bar 98 which may be fitted with three bomb slings. Only one bomb sling 100 is shown in FIG. 4. The bomb slings 100 give the hoist 26 the ability to raise or lower up to three munitions at the same time. The bomb bar 30 interacts with the pneumatic hoist 26 by means of a U-bolt 106. The bomb slings 100 are attached to the bomb bar 30 by means of U-bolts 108 also. A safety hook 110 allows the munition to be safely attached to and transported by a bomb sling 100.

A bomb bar 32 interacts with the pneumatic hoist 28 of the off-load gantry 24 in a similar fashion as shown in FIG. 1.

Figure 5:
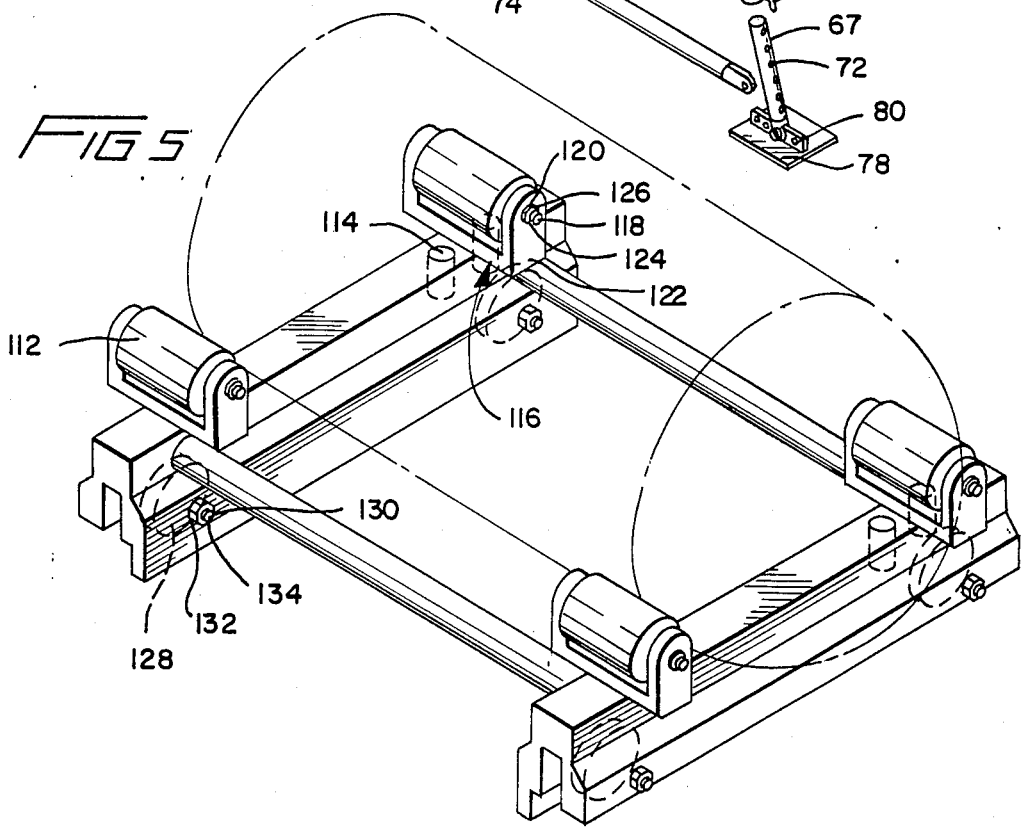
FIG. 5 is a perspective view of a munitions dolly which serves as a transport means for the munitions.

After the bomb body has been raised from the roller conveyor 20 by the bomb bar 30 and pneumatic hoist 26, the hoist trolley 62 allows for the positioning of the bomb body over a munitions dolly 36 which is best shown in FIG. 5. The bomb body is then lowered onto the munitions dolly 36, which is a rectangular structure with an open middle. The munitions dollies 36 have four rollers 112 mounted in their upper sides to provide support for and allow rotation of the munition during build-up. The rollers 112 may be located at different points on the upper side of the dolly in order to allow different sizes of munitions to be transported on the dolly 36 during build-up. The adjustment of the location of the rollers 112 is accomplished by means of a plurality of holes 114 in the upper side of each dolly 36. A mounting rod 116 of each roller 112 may be fit into any of the holes 114 in order to allow a variety of configurations of the mounted rollers 112. The rollers 112 themselves have a shaft 118 with a Teflon sleeve 120 over it upon which the roller 112 is mounted. "Teflon" is a trademark of DuPont for its brand of polytetrafluoroethylene. This roller assemblage is then mounted in a yoke 122 by threading the sleeve 120 covered shaft 118 through holes 124 in the yoke 122 and securing said shaft 118 by means of a retaining ring 126 or other suitable means.

The munitions dollies 36 travel on a rail conveyor 34 by means of bearings 128 that are attached to the dolly frame structure by a bolt 130 that passes through the frame and through the bearing and then out the other side of the frame, and is secured by a washer 132 and nut 134.

Figure 6:
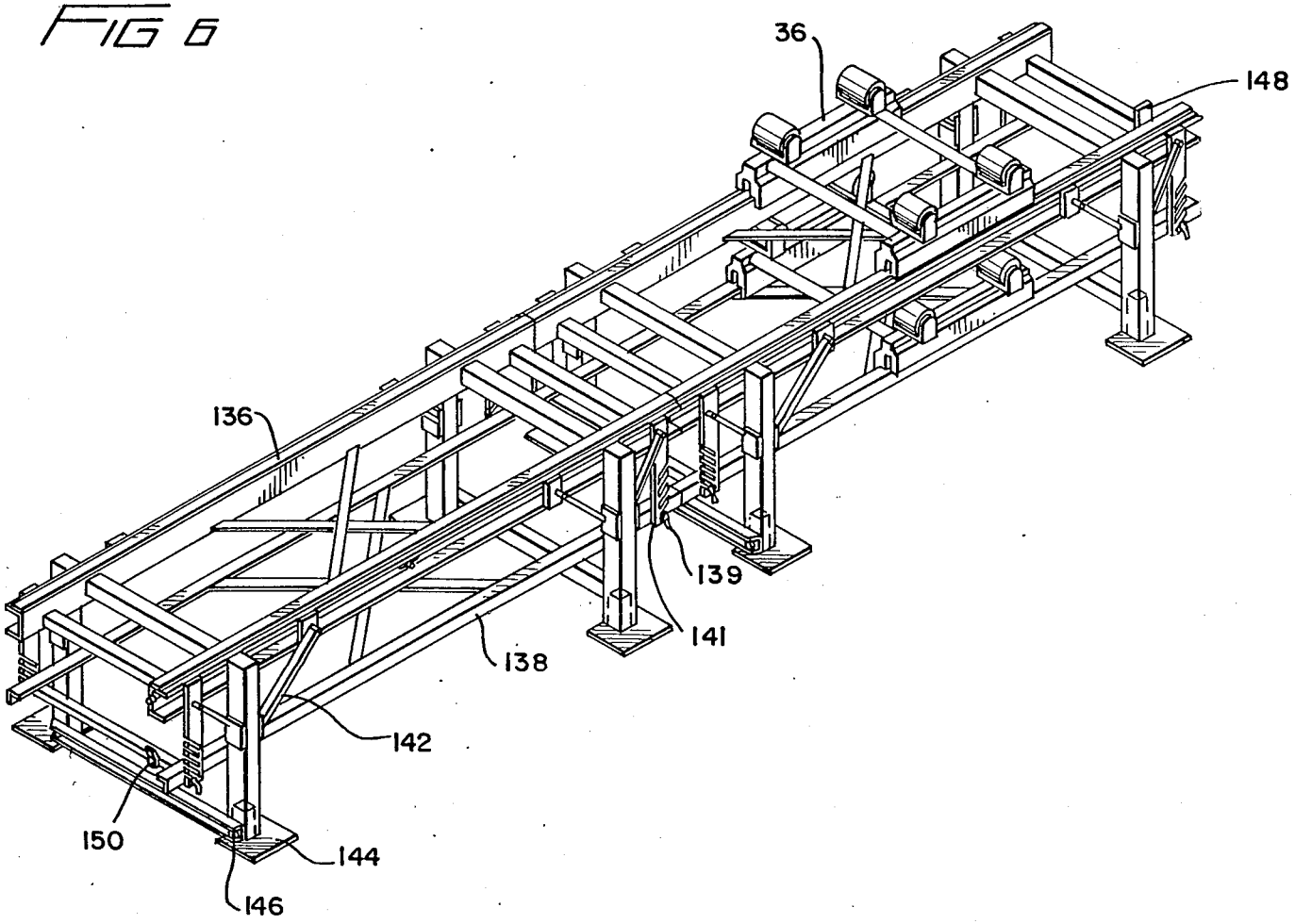
FIG. 6 is a perspective view of the conveyor means; said conveyor means comprising a rail conveyor in the illustrated embodiment.

FIG. 6 shows the rail conveyor 34 upon which the munitions dollies 36 travel. The rail conveyor extends between the on-load gantry 22 and an off-load gantry 24. When travelling from the on-load gantry 22 to an off-load gantry 24, the munitions dollies 36 travel along an upper rail 136 of the rail conveyor 34. Movement of the munitions dollies 36 along the upper rail 136 of the rail conveyor 34 is caused by manual propulsion. After the munition 50 has been lifted from the munitions dolly 36 by the bomb bar 32 at the off-load gantry 24, the munitions dolly 36 is manually removed from the upper rail 136 of the rail conveyor 34 and slidably mounted on a lower rail 138 of the rail conveyor 34. The munitions dollies 36 return to the on-load gantry 22 by travelling along the lower rail 138 on the underside of the rail conveyor 34. This lower rail is designated the return rail. The rail conveyor 34 is supported by adjustable legs 140 and by braces 142. Feet 144 are located at the bottom of the legs 140 and the connection means between the feet 144 and legs 140 is a quick-release pin 146. The quick release pin 146 allows for adjustment of the height of the rail conveyor 34. The rail conveyor 34 extends approximately 51 inches under the on-load gantry 22 as well as the off-load gantries 24.

Rail stops 148 are located at the end of the rail conveyor 34 which is located under the off-load gantry 24. Return rail stops 150 are located at the end of the return rail 138 located under the on-load gantry 22. The rail stops 148 and 150 prevent the dollies 36 from rolling past the ends of the rail conveyor 34 and causing damage to munitions or equipment and injury to personnel.

The rail conveyor 34 is assembled in such a manner that, preferably, there is no slope to the upper rail 136. The upper rail 136 requires no slope because the munition dolly 36 can be moved along the upper rail manually with relative ease. In contrast, the return rail 138 has a slight slope downward (preferably 3% slope) from the off-load gantry 24 to the on-load gantry 22. The slope of the return rail 138 can be adjusted by the interaction of rail pins 139 with return rail slope adjustment slots 141. The slope adjustment slots 141 also allow a smooth mating of sections of the return rail 138. The incline of the return rail 138 allows the munition dollies 36 to return to the on-load gantry end of the rail conveyor 36 without the need for manual propulsion.

Figure 7:
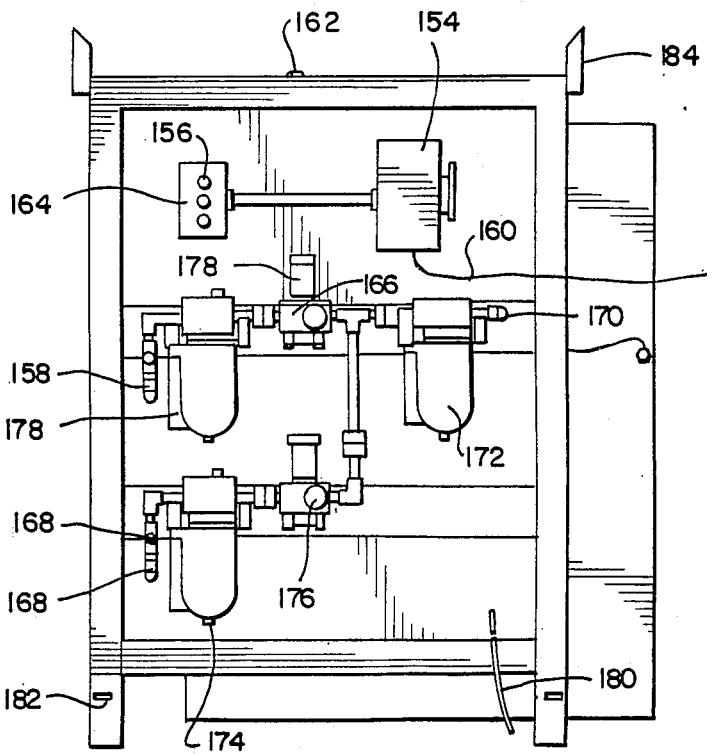
FIG. 7 is a frontal cut-away view of the interface control board illustrating the internal components thereof.

The interface control board 152, illustrated in FIG. 7, routes electrical and pneumatic power to the munitions assembly system. The electrical power is supplied by an electric generator (not shown), that is the source of 115 VAC power. The electrical aspects of the interface control board 152 consist of a safety switch 154 and a receptacle 156 for use with a lighting system 40 of the munitions assembly system. The pneumatic power is supplied by an air compressor (not shown). The pneumatic power is utilized by the pneumatic hoists 26 and 28 attached to the on-load gantry 22 and off-load gantries 24 respectively, and also at various points along the rail conveyor 34 to power pneumatic tools. The pneumatic power is carried by hoses 158 running between the interface control board 152 and the rail conveyor 34 and the gantries 22 and 24. The electric power is carried by wires 160 which run from the interface control board 152 to the lighting systems 40.

A quick release pin 162 at the top of the interface control board 152 allows for quick and easy access to the interior workings of said interface control board 152. The interior of the interface control board 152 contains a receptable box 164, a pressure regulator 166, a plurality of air outlet couplings 168, an air inlet coupling 170, an air filter 172, an oil lubricator 174, a pressure gauge 176, a regulator adjustor 178 and a ground strap 180.

The interface control board 152 is also utilized in setting up the munitions assembly system. The interface control board 152 is used as a forklift adapter to aid in raising the gantries to their full height. There are forklift slots 182 located at the bottom of the interface control board 152 to enable the forklift and interface control board 152 to coact. Gantry beam slots 184 located at the upper portion of the interface control board 152 then engage the I-beam 60 of the on-load gantry 22 or the off-load gantry 24 to enable either of said gantries to be elevated to its full height.

After its use as a forklift adapter, the interface control board 152 is then located adjacent to the rail conveyor 34 and functions as an electric and pneumatic power source.

One of the tasks performed on the warhead as it moves along the rail conveyor 34 on the munitions dolly 36 is the addition of arming wire 186. The arming wire 186 is provided from an arming wire dispenser 38 which is shown at FIG. 8. The arming wire dispenser 38 accepts spools 188 of arming wire and has a gripping mechanism 190 to prevent unwinding of the wire from the spool 188.

The arming wire dispenser 38 comprises a brake 192, a brake pad 194, an axle support 196, an axle 198, a straightening tube 200 and a tension spring 202. The arming wire dispenser 38 has a rectangular base 204 with appendages 206 that are arranged so as to create triangular shaped structures at two opposite sides of said rectangular base. At the apex of each triangular structure remote from the rectangular base, the axle supports 196 are attached.

From about the midpoint of two opposite sides of the rectangular base 204 (below the apex of each triangular structure), project support means 208 for the straightening tube 200. The support means 208 is attached to the arming wire dispenser structure at the point at which it projects from the rectangular base 204 as well as at a point on one of the appendages 206 of each respective triangular structure.

The tension spring 202 interacts with the brake 192 which has the brake pad 194 attached thereto, to prevent the backlash of the arming wire 186 after it has been pulled out to the required length and cut. When the wire is pulled out, it travels through the straightening tube 200. The diameter of the straightening tube 200 is only slightly greater than that of the wire 186. The small difference in diameters forces the wire to rid itself of all but the smallest bends and kinks in order to ensure its passage through the straightening tube 200.

The axle 198 is inserted through the middle of the spool 188 of wire and has a portion extending beyond each end of the spool 188. The extended portions of the axle 198 interact with a U-shaped groove 210 in each respective axle support 196. This interaction allows the axle 198 to be held in place, while the spool 188 of arming wire may freely rotate about the axle 198 under the pressure of the brake pad 194 and brake 192.

The pressure on the spool 188 from the brake pad 194 is created by the tension spring 202 which is connected at one end to the brake 192 and at the other end to one of the appendages 206 of one of the triangular structures of the arming wire dispenser 38. The tension is applied directly to the spool 188 of arming wire due to the contact of the brake pad 194 on the arming wire spool 188.

The lighting systems 40 of the munitions assembly system are shown in FIGS. 1 and 3. One lighting system is mounted on I-beam 60 of the on-load gantry 22 by means of bracket 212. The other lighting system is mounted on I-beam 61 of the off-load gantry 24 by means of bracket 214. The lighting systems 40 preferably use sodium vapor bulbs. Cords 216 containing the wiring to supply the electric power travel from the interface control board 152 to the lighting systems 40.

The adjustment bar 42 is shown in FIG. 9 and is used to level the gantries after they have been assembled. If the gantries become uneven, an adjustment bar 42 is used to raise or lower the legs 68 in order to get the gantry back to a level state. When interacting with the gantry legs, the arm adapter 222 of the adjustment bar 42 is inserted into an adjusting hole 72 of the inner leg section 67 of a gantry. Next, an arm 220 of the adjustment bar 42 mates with the lift tab 73 of the outer leg section 69 of a gantry leg 68. A downward force applied on the handle 218 of the adjustment bar 42 causes the outer leg section 69 to be raised a maximum of two holes. The hitch pin 70 is replaced through the aligned holes 72 and 71 of the inner and outer legs, respectively, before the adjustment bar 42 is removed. The adjustment bar 42 also aids in assembling and disassembling the rail conveyor 34. During assembly, the adjustment bar 42 is used to pull the sections together, while during disassembly the adjustment bar 42 helps force the sections apart.

Restraint straps 44, shown in FIG. 1, are utilized at the various work stops along the rail conveyor 34. The restraint straps 44 are used to secure the munition body 50 in place and prevent said munition body 50 from turning while torque is being applied. When in use, the restraint strap 44 is secured to the munition body 50 and the rail conveyor 34.

Figure 10:
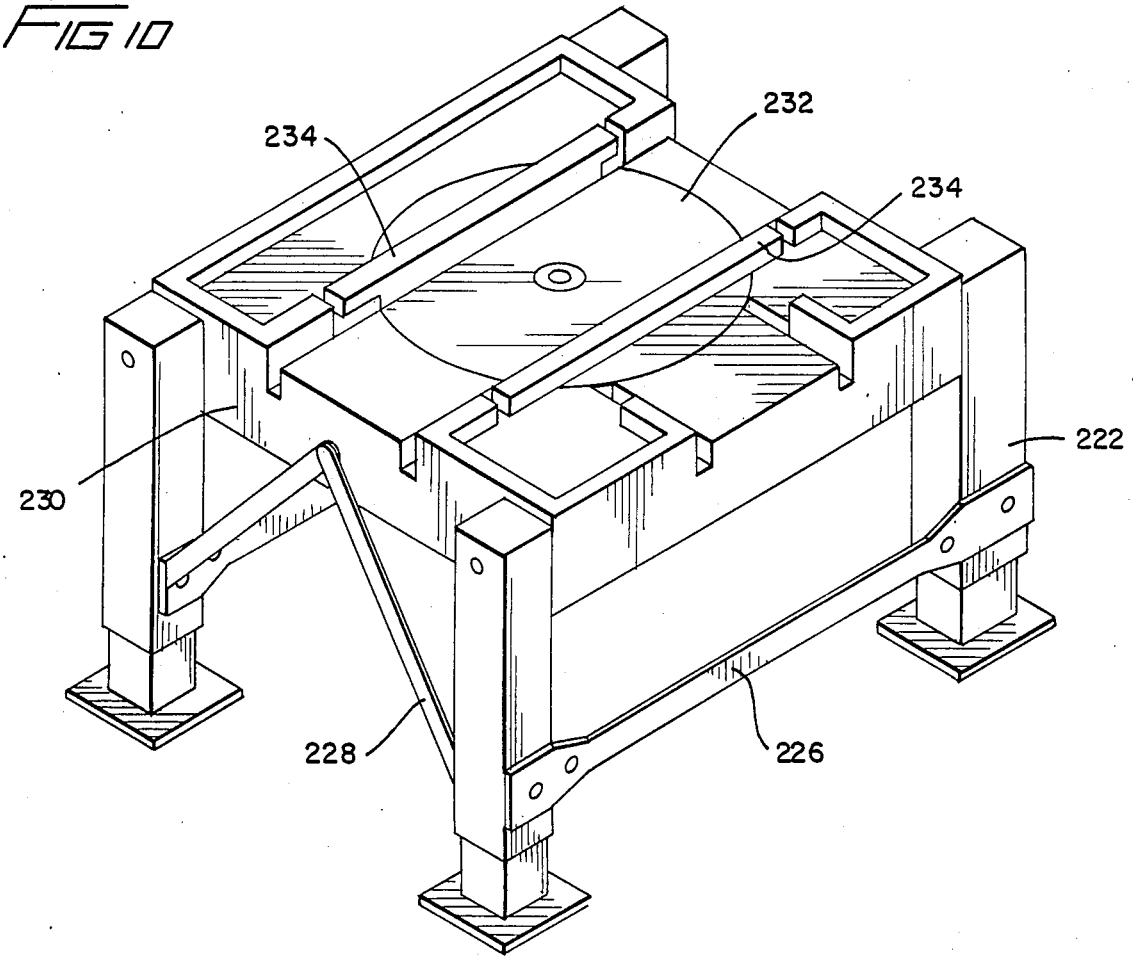
FIG. 10 is a perspective view of the turntable device used when the munitions assembly system is arranged in an L-shaped configuration.
Figure 11:
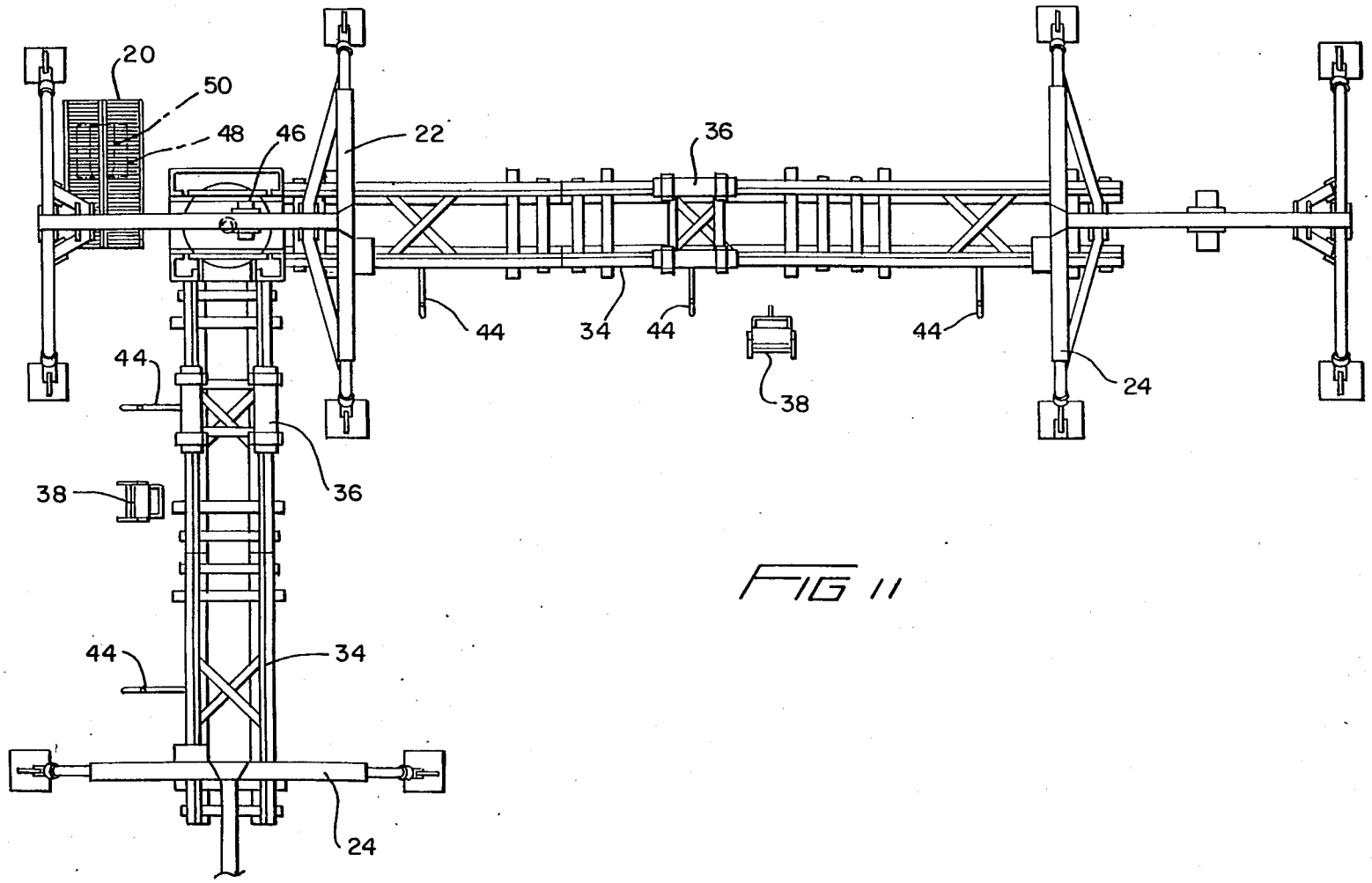
FIG. 11 is a top plan view of the munitions assembly system when arranged in an L-shaped configuration.

The turntable device 46, shown at FIG. 10, is used to permit the munitions assembly system to be configured into an "L" shape if space is constrained. The turntable device 46 has four legs 224 which are adjustable in length. The legs 224 are supported by two types of bracing means. Each bracing means is attached to two legs 224 of the turntable device 46. Like bracing means are on opposite sides of the turntable device 46. One type of bracing means is a support 226 extending between two legs 224 and being parallel to the upper surface of the turntable device. The other type of bracing means is a support 228 that extends between two legs and forms an apex at a point midway between the two legs 224, said apex being attached at a point on a rectangular upper portion 230 of said turntable device 46. The rectangular upper portion 230 is attached at each corner thereof to a leg 224. Within the rectangular upper portion 230 is a circular aspect 232 which is pivotally mounted. The bearings 128 of munitions dollies 36 roll along two raised rectangular rails 234 located on the upper face of said circular aspect 232. Positive detent locks ensure that the circular aspect 232 is secured when its rails 234 align with the upper rail 136 of the rail conveyor 34. The turntable device 46 is located at a position below the I-beam 60 of the on-load gantry 22 as shown in FIG. 11.

The munitions assembly system operates much like an assembly line for the buildup and arming of a munition. The unarmed munition body 50 arrives in a container or disposed on a pallet. The carton or pallet is placed on the roller conveyor 20 which has a slight decline towards its end point below the I-beam 60 of the on-load gantry 22. The slope of the roller conveyor 20 allows for ease in transport of the carton or pallet from the unloading point to the breakout point. A pallet stop 58 at the gantry end of the roller conveyor 20 prevents the carton or pallet from moving off the end of the roller conveyor 20 and causing damage and/or injury.

Once stopped, the munition body 50 is removed from its carton and removably attached to a bomb bar 30. If the munition body 50 is disposed on a pallet it is just removably attached to the bomb bar 30. Up to three munition bodies 50 may be attached to the bomb bar 30. The bomb bar 30 is then elevated by means of a pneumatic hoist 26. The pneumatic hoist 26 is movable along the length of the I-beam 60 located at the apex of the A-frame on-load gantry 22 by means of a hoist trolley 62. The hoist trolley 62 causes the hoist 26, bomb bar 30, and munition body 50 to move to a position above a munitions dolly 36 which is located on the upper rail 136 of the rail conveyor 34.

As the munitions dolly 36 travels along the upper rail 136 of the rail conveyor 34, it stops at points for buildup and arming tasks to be performed on the munition body 50. Restraint straps 44 are located at the task points to secure the munition body 50 in place on the munition dolly 36 as torque is applied to the munition. One of the arming tasks is the provision of arming wire 186 to the munition which is accomplished with the aid of the arming wire dispenser 38.

Arming wire 186 is dispensed by manually pulling the wire through the straightening tube 200 of the dispenser and across the length of the munition 50. The brake pad 194, which is attached to the brake 192 of the dispenser, puts pressure on the spool 188 of arming wire 186 to prevent the wire 186 from snapping back when cut. The pressure on the wire spool 188 is not enough to hinder the dispensing of the wire 186 from the dispenser 38.

When all of the buildup and arming tasks have been completed, the munition 50, on the munitions dolly 36, travels to the end of the upper rail 136 of the conveyor 34 where the dolly 36 stops when it comes in contact with the rail stop 148. At this time, the armed munition 50 is removed from the dolly 36 by means of a bomb bar 32 which is attached to a pneumatic hoist 28. The hoist trolley 62 moves the hoist 28 and hence the bomb bar 32 and munition 50 to a location beneath the off-load gantry 24 where the munition 50 may be lowered into a munitions trailer for delivery. The emptied munitions dolly 36 is manually removed from the upper rail 136 of the rail conveyor 34 and slidably mounted on the return rail 138 for return to the on-load gantry 22.

The turntable device 46 allows for modifications of the basic structure of the munitions assembly system. One modification which the turntable device 46 permits is an L-shaped configuration as illustrated in FIG. 11, to allow use of the munitions assembly system even in relatively confined spaces. Two rail conveyors 34, each with its own off-load gantry 24, form the legs of the L. The junction of the two legs is at the on-load gantry 22, under which is located the turntable device 46. In this configuration, the munition pallets or containers travel down the roller conveyor 20 to the break-out area beneath the on-load gantry 22. The broken-out munition body 50 is raised by the bomb bar 30 and hoist 26 and then moved by means of the hoist trolley 62 to a point over the munitions dolly 36 whose bearings 128 roll along the two raised rectangular rails 234 on the upper face of the circular aspect 232 of the turntable device 46.

When the munition body 50 has been positioned on the munitions dolly 36, the circular aspect 232 of the turntable device 46 is rotated 90 degrees so that the two raised rails 234 of the turntable device 46 align with the upper rails 136 of the rail conveyor 34. The munitions dolly 36 then travels along the rail conveyor 34 and the munition 50 is built-up and armed at the various task-performing stations along the rail conveyor 34.

The turntable device 46 allows the munition laden munition dolly 36 located on the circular aspect 232 of said turntable device 46 to travel on any one of the two rail conveyors 34 that interact with the turntable device 46 to form the L-shaped configuration. This configuration allows multiple sequences of munition build-up and arming to occur simultaneously.

One major advantage of the munitions assembly system is that the munitions can be built-up and armed at a much faster rate than with other systems currently available.

Another advantage is in the reduction of physical exertion by technicians performing the build-up and arming tasks. The technicians no longer have to bend over the munition and work in this bent-over position for extended periods of time.

While the invention has been disclosed by reference to the details of preferred embodiments, this disclosure is intended in an illustrative rather than in a limiting sense, as it is contemplated that modifications will readily occur to those skilled in the art, within the spirit of the invention and the scope of the appended claims.

What is claimed is:

1. A munitions assembly system comprising:
an on-load gantry;
an off-load gantry;
hoisting means attached to each of said gantries;
conveyor means extending between the on-load gantry and an off-load gantry;
a plurality of transport means which travel on said conveyor means; and
an arming wire dispenser located adjacent said conveyor means, said arming wire dispenser supplying arming wire from a spool through a straightening tube to a munition to be armed.

2. A munitions assembly system as claimed in claim 1, further comprising a bomb bar attached to said hoisting means.

3. A munitions assembly system as claimed in claim 2, further comprising a second conveyor means extending from a point beneath said on-load gantry.

4. A munitions assembly system as claimed in claim 1, in which said gantries each comprise two A-frame structures connected at their apexes by a support beam.

5. A munitions assembly system as claimed in claim 4, in which the A-frame structures comprise legs and cross bars which are adjustable in length.

6. A munitions assembly system as claimed in claim 5, in which foot pads are attached to said legs.

7. A munitions assembly system as claimed in claim 1, in which said hoisting means comprise pneumatic hoists.

8. A munitions assembly system as claimed in claim 3, in which said conveyor means comprises a rail conveyor extending between the on-load gantry and the off-load gantry, and said second conveyor means comprises a roller conveyor extending between an unloading site and the on-load gantry.

9. A munitions assembly system as claimed in claim 8, in which said rail conveyor provides means for return of said transport means from the off-load gantry to the on-load gantry.

10. A munitions assembly system as claimed in claim 2, in which said bomb bar includes means for transporting at least three munitions at one time.

11. A munitions assembly system as claimed in claim 1, in which said transport means comprise dollies.

12. A munitions assembly system as claimed in claim 7, further comprising an interface control board, said interface control board permits control of pneumatic power necessary to operate said pneumatic hoists.

13. A munitions assembly system as claimed in claim 1, further comprising a restraint strap attached to said second conveyor means, said restraint strap being attachable to a munition being carried on said transport means to prevent said munition from turning while torque is being applied.

14. A munitions assembly system as claimed in claim 1, further comprising an adjustment bar, said adjustment bar capable of interacting with the legs of said on-load gantry and said off-load gantries to level said gantries when said gantries are found to be unlevel.

15. A munitions assembly system comprising:
an on-load gantry;
a plurality of off-load gantries;
hoisting means attached to each of said gantries;
a turntable device located beneath said on-load gantry;
conveyor means that align with said turntable device and extend to said off-load gantries;
transport means which may be loaded with a bomb body while on said turntable device and then travel on said conveyor means to said off-load gantries; and
an arming wire dispenser located adjacent said conveyor means, said arming wire dispenser supplying arming wire from a spool through a straightening tube to the bomb body.

16. A munitions assembly system as claimed in claim 15, further comprising a bomb bar, said bomb bar being attached to said hoisting means.

17. A munitions assembly system as claimed in claim 15, further comprising a second conveyor means extending from a point beneath said on-load gantry.

* * * * *